US006595009B1

(12) United States Patent
Howard et al.

(10) Patent No.: US 6,595,009 B1
(45) Date of Patent: Jul. 22, 2003

(54) METHOD FOR PROVIDING REFRIGERATION USING TWO CIRCUITS WITH DIFFERING MULTICOMPONENT REFRIGERANTS

(75) Inventors: Henry Edward Howard, Grand Island, NY (US); Martin Lee Timm, Getzville, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/196,420

(22) Filed: Jul. 17, 2002

(51) Int. Cl.[7] ..... F25B 7/00
(52) U.S. Cl. ..... 62/79; 62/612; 62/335
(58) Field of Search ..... 62/113, 79, 114, 62/335, 513, 612

(56) References Cited

U.S. PATENT DOCUMENTS 4,028,079 A 6/1977 Scheibel ..... 62/335
5,729,993 A 3/1998 Boiarski et al. ..... 62/175
6,076,372 A 6/2000 Acharya et al. ..... 62/606
6,105,388 A 8/2000 Acharya et al. ..... 62/612
6,176,102 B1 1/2001 Novak et al. ..... 62/612
6,327,865 B1 * 12/2001 Bonaquist et al. ..... 62/79
6,327,866 B1 12/2001 Novak et al. ..... 62/114
6,357,257 B1 3/2002 Goble, Jr. et al. ..... 62/613
6,494,054 B1 * 12/2002 Wong et al. ..... 62/335

* cited by examiner

*Primary Examiner*—William E. Tapolcai
(74) *Attorney, Agent, or Firm*—Stanley Ktorides

(57) ABSTRACT

A method for providing refrigeration wherein a first multicomponent refrigerant is condensed to form a saturated liquid and vaporized against a condensing second multicomponent refrigerant which has a dew point less than the dew point and preferably the bubble point of the saturated liquid, and has a bubble point greater than that of the vaporizing first multicomponent refrigerant, and after providing refrigeration to a refrigeration load, may be superheated against the condensing first and second multicomponent refrigerants.

12 Claims, 2 Drawing Sheets

METHOD FOR PROVIDING REFRIGERATION USING TWO CIRCUITS WITH DIFFERING MULTICOMPONENT REFRIGERANTS

TECHNICAL FIELD

This invention relates generally to the generation and the provision of refrigeration using a multicomponent refrigerant.

BACKGROUND ART

Refrigeration is used extensively in the freezing of foods, production of pharmaceuticals, liquefaction of natural gas, and in many other applications wherein refrigeration is required to provide cooling duty to a refrigeration load.

A recent significant advancement in the field of refrigeration is the development of refrigeration systems using multicomponent refrigerants which are able to generate refrigeration much more efficiently than conventional systems. These refrigeration systems, also known as mixed gas refrigerant systems or MGR systems, are particularly attractive for providing refrigeration at very low or cryogenic temperatures such as below −80° F.

Typically an MGR system employs a single circuit system. Such systems are uncomplicated from an equipment standpoint, but several operational issues limit their effectiveness. Among these issues is the problem of handling two-phase refrigerant mixtures. In particular, if the point of refrigeration use is substantially separated from the primary compression and heat exchange equipment, liquid stagnation-separation can occur in return piping or in vaporizing exchanger passes. In addition, low temperature partial evaporators may have problems motivating the high boiling constituents to exit the exchanger. This will result in a deterioration of the composite approaches and hence increase power consumption. Both of these issues result in complications to the process including higher design pressure drops and the necessity of cold end phase separators. The equipment and power cost associated with addressing these problems can become significant.

With the phase out of CFC's, a second complication exists for refrigerant systems based upon zeotropic mixtures. Such systems must often rely upon non-conventional refrigerants such as fluoroethers for high boiling service. By high boiling it is meant those refrigerant constituents that under typical system pressures boil or condense near the temperature of the ambient utility (air/water/chilled water). These high boiling refrigerants typically are often costly and/or are somewhat toxic. In distributed refrigeration applications like food processing, this represents a substantial problem. First, remote refrigerant use will necessitate the purchase of substantial quantities for system charge. Secondly, distributed use is often associated with the transit of refrigerants across or near occupied space. As a consequence, there are additional safety precautions that must be made. For instance, when evaporators need servicing they must be safely evacuated. The presence of a semi-toxic high boiler complicates such a procedure.

Accordingly it is an object of this invention to provide a method for providing multicomponent refrigeration which reduces or eliminates problems associated with heretofore available such systems such as cold end phase separation, increased refrigeration charging costs, and potential toxic refrigerant contamination.

SUMMARY OF THE INVENTION

The above and other objects, which will become apparent to those skilled in the art upon a reading of this disclosure, are attained by the present invention which is:

A method for providing refrigeration comprising:

(A) condensing a first multicomponent refrigerant to produce a saturated liquid, expanding the saturated liquid first multicomponent refrigerant, and vaporizing the expanded first multicomponent refrigerant by indirect heat exchange with the condensing first multicomponent refrigerant.

(B) condensing a second multicomponent refrigerant by indirect heat exchange with the vaporizing first multicomponent refrigerant, said second multicomponent refrigerant having a dew point which is less than the dew point of said saturated liquid first multicomponent refrigerant, and said second multicomponent refrigerant having bubble point which is greater than the bubble point of said vaporizing first multicomponent refrigerant; and (C) vaporizing the condensed second multicomponent refrigerant by passing heat from a refrigeration load into the condensed second multicomponent refrigerant thereby providing refrigeration to the refrigeration load; and As used herein the term "expansion" means to effect a reduction in pressure.

As used herein the term "expansion device" means apparatus for effecting expansion of a fluid.

As used herein the term "compressor" means apparatus for effecting compression of a fluid.

As used herein the term "multicomponent refrigerant" means a fluid comprising two or more species and capable of generating refrigeration.

As used herein the term "refrigeration" means the capability to absorb heat from a subambient temperature system and to reject it at a superambient temperature.

As used herein the term "refrigerant" means fluid in a refrigeration process which undergoes changes in temperature, pressure and possibly phase to absorb heat at a lower temperature and reject it at a higher temperature.

As used herein the term "subcooling" means cooling a liquid to be at a temperature lower than the saturation temperature of that liquid for the existing pressure.

As used herein the term "superheating" means warming a gas above the saturation/dew point.

As used herein the term "indirect heat exchange" means the bringing of fluids into heat exchange relation without any physical contact or intermixing of the fluids with each other.

As used herein the term "refrigeration load" means a fluid or object that requires a reduction in energy, or removal of heat, to lower its temperature or to keep its temperature from rising.

As used herein the term "saturated liquid" means a liquid that is at a temperature at which the application of heat will initiate vaporization.

As used herein the term "dew point" means the temperature at which condensation of a vapor first commences.

As used herein the term "bubble point" means the temperature at which vaporization of a liquid first commences.

DETAILED DESCRIPTION

In general, the invention utilizes two multicomponent refrigerant circuits with a common heat exchanger. The two refrigeration circuits are segregated and each utilize their own compressor and ambient cooling means. The two refrigerant mixtures are each substantially condensed in the common primary heat exchanger. The first refrigerant is vaporized in the warming passes of the heat exchanger as it supplies condensing duty to both of the refrigerants that are entering the heat exchanger after the ambient cooling. The second refrigerant cools the refrigeration load. The refrigerant compositions are selected so that the bubble point of each cooling stream is above the bubble point of the depressurizing first stream.

Figure 1:
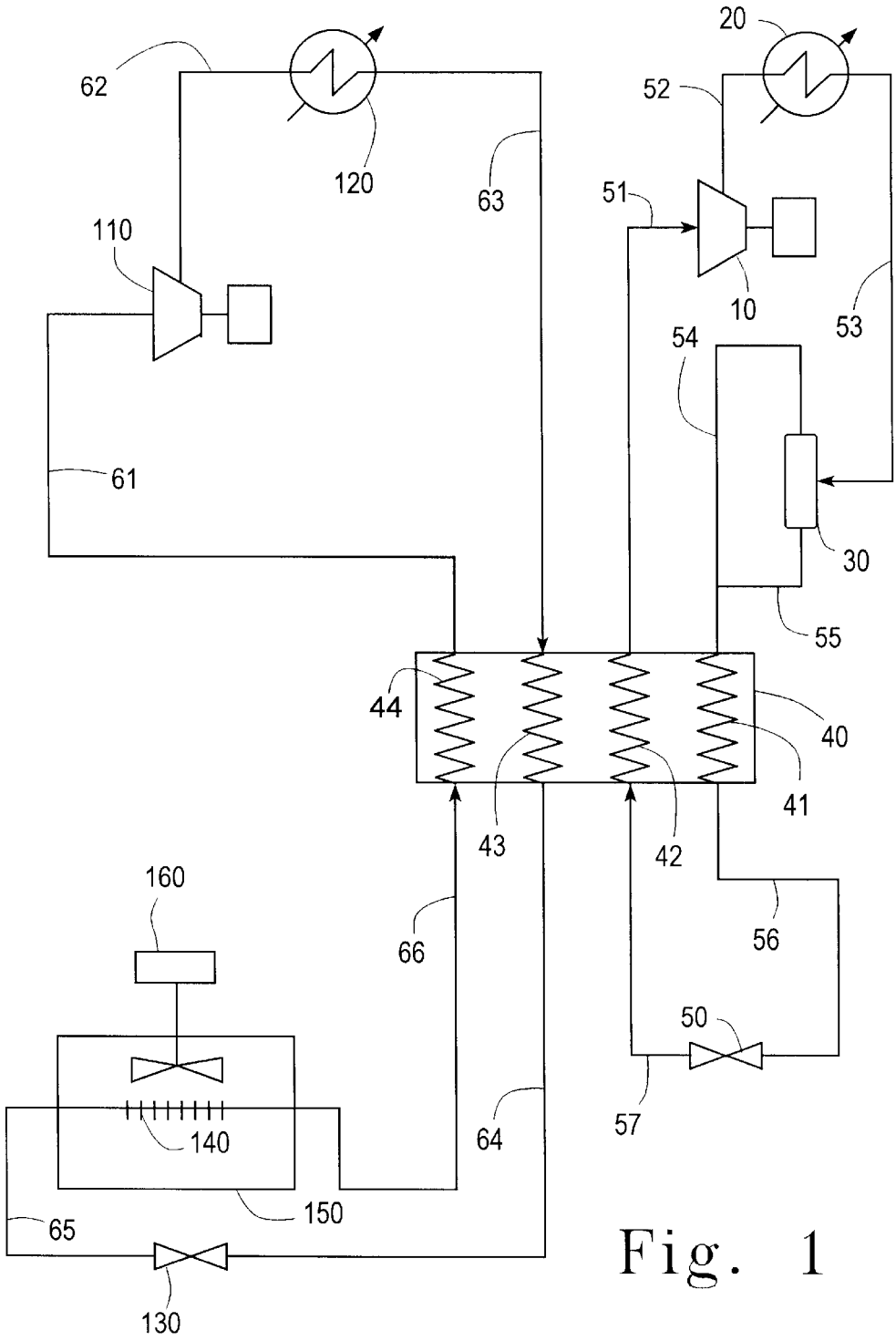
FIG. 1 is a schematic representation of one preferred arrangement which may be used in the practice of this invention.

The invention will be described in detail with the reference to the Drawings. Referring now to FIG. 1, first multicomponent refrigerant in stream 51 is compressed by passage through compressor 10 to a pressure typically within the range of from 200 to 400 pounds per square inch absolute (psia) to form compressed first multicomponent refrigerant stream 52. Stream 52 is cooled and partially condensed by indirect heat exchange within an ambient utility, typically air or water, in cooler 20 and then passed in two phase stream 53 to phase separator 30 wherein it is separated into vapor and liquid portions. The vapor portion is withdrawn from phase separator 30 in stream 54 and the liquid portion is withdrawn from phase separator 30 in stream 55, and these two streams are independently distributed into common pass 41 of primary heat exchanger 40. Within pass 41 the first multicomponent refrigerant mixture is completely condensed and preferably subcooled, and exits primary heat exchanger 40 as liquid stream 56.

The composition of the first multicomponent refrigerant is selected so as to achieve a saturated liquid state at the high side pressure at a temperature generally greater than −80° F. Typical components of the first multicomponent refrigerant include components from groups classified as fluorocarbons, hydrofluorocarbons, fluoroethers, hydrocarbons and atmospheric gases.

Liquid, preferably subcooled, multicomponent refrigerant stream 56 is expanded by passage through an expansion device such as valve 50 to a pressure typically within the range of from 20 to 150 psia to generate refrigeration, and is then passed in stream 57 to heat exchanger pass 42 of primary heat exchanger 40. Within pass 42 the first multicomponent refrigerant is vaporized by indirect heat exchange with the condensing first multicomponent refrigerant and also with condensing second multicomponent refrigerant which will be further described below. The vaporization of the first multicomponent refrigerant in pass 42 is over a temperature range spanning the entire length and temperature span of primary heat exchanger 40. The temperature span of heat exchanger 40 is typically from 100° F. to −115° F. After vaporization in pass 42 the first multicomponent refrigerant is withdrawn from heat exchanger 40 in stream 51 and passed to compressor 10 to complete the circuit.

Second multicomponent refrigerant in stream 61 is compressed by passage through compressor 110 to a pressure typically within the range of from 200 to 400 psia to form compressed second multicomponent refrigerant stream 62 and then aftercooled in aftercooler 120 by indirect heat exchange with an ambient utility. The second multicomponent refrigerant undergoes no condensation within aftercooler 120. Second multicomponent refrigerant exits aftercooler 120 in stream 63 in a substantially superheated state and is directed to heat exchanger pass 43 of primary heat exchanger 40 wherein it is desuperheated and substantially condensed by indirect heat exchange with the aforesaid vaporizing first multicomponent refrigerant in pass 42. The condensation of the second multicomponent refrigerant in pass 43 commences generally at temperatures below −80° F.

The constituents of the second multicomponent refrigerant are selected from the groups of fluorocarbons, hydrofluorocarbons and atmospheric gases. A particularly advantageous mixture is obtained by varying portions of fluoroform ($CHF_3$), tetraf luoromethane ($CF_4$) and Argon (Ar). Mixtures containing from 85 to 95 mole percent $CF_4$ have been found to be particularly effective in achieving refrigeration temperatures between −110° F. and −160° F. Also, for temperatures in the range of from −70° F. to −110° F., mixtures comprising from 85 to 95 mole percent tetrafluoromethane and/or hexafluoroethane with the balance fluoroform and/or R125 have been found to be particularly effective. The constituents and proportions of the second multicomponent refrigerant are selected so that the condensation of the second refrigerant mixture commences in pass 43 at a temperature lower than the saturated liquid temperature of the first multicomponent refrigerant in pass 41, and so that the second multicomponent refrigerant mixture achieves a saturated liquid state at a temperature higher than the bubble point of the first depressurized or returning multicomponent refrigerant in pass 42. That is, the high pressure second multicomponent refrigerant has a dew point which is less than the dew point of the saturated liquid first multicomponent refrigerant, and has a bubble point which is greater than the bubble point of the vaporizing first multicomponent refrigerant. Preferably, the second high pressure condensing multicomponent refrigerant has a dew point which is less than the bubble point of the first high pressure condensing multicomponent refrigerant.

Second multicomponent refrigerant exits pass 43 of primary heat exchanger 40 in a liquid and preferably a subcooled state in stream 64. This stream is then directed to the refrigeration load which, in the embodiment of the invention illustrated in the Figures, is food freezer 150. At a point near to which refrigeration is required, the second multicomponent refrigerant in stream 64 is throttled down in pressure through valve 130 to a pressure generally within the range of from 50 to 150 psia. Resulting expanded second multicomponent refrigerant stream 65 is passed into food freezer 150 and enters primary evaporator or evaporators 140 wherein heat from the refrigeration load is passed into the second multicomponent refrigerant thereby providing refrigeration to the refrigeration load. In the case of a food freezing load, the heat from the refrigeration load may be imparted to the second multicomponent refrigerant through the recirculation of freezer air by way of motor driven blower or fan 160. Within heat exchanger or evaporator 140 the second multicomponent refrigerant is substantially vaporized at the low side system pressure. Resulting second multicomponent refrigerant is passed from the refrigeration load in stream 66 to pass 44 of primary heat exchanger 40 wherein it is superheated by indirect heat exchange with the condensing second multicomponent refrigerant in pass 43 and with the condensing first multicomponent refrigerant in pass 41. The second multicomponent refrigerant is withdrawn from heat exchanger 40 in stream 61 and passed to compressor 110 to complete the circuit.

Figure 2:
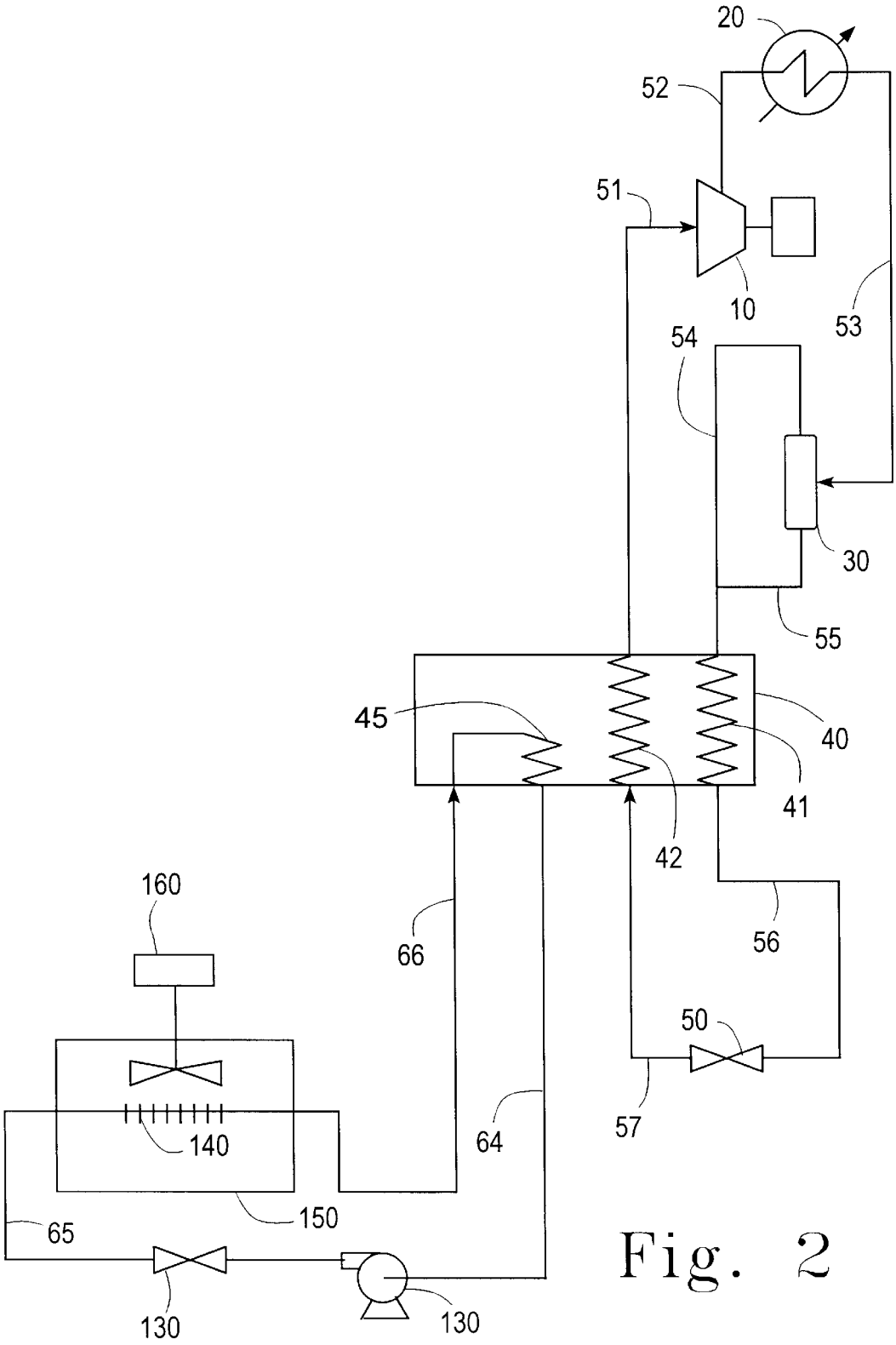
FIG. 2 is a schematic representation of another preferred arrangement which may be used in the practice of this invention.

FIG. 2 illustrates another preferred embodiment of the invention. The numerals in FIG. 2 are the same as those of FIG. 1 for the common elements, and these common elements will not be discussed again in detail.

Referring now to FIG. 2, condensed second multicomponent refrigerant in stream 64 is pumped to an elevated pressure in mechanical liquid pump 130. The increase in pressure is typically about 20 to 30 psi. After the heat exchange with the refrigeration load, the vaporized second multicomponent refrigerant in stream 66 is returned to heat exchanger 40 and directed interstage into cooling pass 45. Within cooling pass 45 the second multicomponent refrigerant is condensed and preferably subcooled. The system illustrated in FIG. 2 is particularly amenable to the delivery of refrigeration over the temperature range of from −70° F. to −100° F.

To supply refrigeration to the load-bearing evaporator of a food freezer in the temperature range of −110° F. to −160° F., a preferred composition of the second multicomponent refrigerant will contain a mixture containing at least 80 mole percent $CF_4$. The remaining components of such a mixture will typically be distributed between $CHF_3$ and an inert, deep condensable atmospheric gas e.g. Ar or $N_2$. Table 1 provides a representative range of refrigerant compositions suitable for use with the processes illustrated in the Figures.

TABLE 1

| | Mole % Range | |
|---|---|---|
| Component | Circuit 1 | Circuit 2 |
| $Ar—N_2$ | 0–10 | 0–20 |
| $CF_4$ | 20–60 | 80–99 |
| $CHF_3$ | 0–30 | 0–20 |
| $C_2HF_5$ | 10–50 | 0–5 |
| $C_3F_7—O—CH_3$ | 0–20 | — |

The composition of the first multicomponent refrigerant is dictated by the need to absorb the condensing load over the entire temperature span of the primary heat exchanger. A representative listing of such components is found in U.S. Pat. No. 6,176,102 at from column 2, line 32 to column 3, line 15, which portion is incorporated herein by reference.

Relative to the process shown in the Figures it is often advantageous to employ surge vessels in zeotropic refrigeration circuits in order to buffer pressure fluctuation in addition to providing a refrigerant storage means upon shutdown. Although such vessels are not shown in the Figures they may be included in each refrigerant circuit. In addition, pump down compressors may also be included for purposes of evacuating (into the surge vessel) the refrigerant piping so that service may be performed. For the first refrigerant circuit, it may be advisable to employ a suction disengagement drum (not shown). Such a vessel would be connected to exiting pass 42. Such a vessel serves to protect the compressor (from liquid refrigerant carry over). In addition, such a vessel will enable periodic mixture composition adjustment in response to variations in ambient or process conditions.

Deep levels of oil removal are often necessitated with the use of HFC type refrigerants due to low miscibility or the potential for cold end freeze-out. Although not shown in the Figures, such steps may be performed after compressors 10 and 110. Such steps may comprise several stages of fiber coalescing filters and the like. In addition, primary oil removal/coalescing may be performed within the context of the compression equipment. This is particularly the case with the use of oil flooded screw compressors.

Compressors 10 and 110 may comprise any number of machines configured in parallel or series. Such machines may be intercooled as necessary. Applicable compressor types include reciprocating, centrifugal or oil flooded screw. The drive mechanism for each compressor is typically an electric motor. Alternatively the compression drive means may be accomplished through the use of a reciprocating-internal combustion engine or through the shaft work generated by the expansion of another process fluid, e.g. steam.

Alternative exchanger designs may be used. For instance, heat exchanger 20 may be a shell and tube exchanger. In such a configuration, refrigerant stream 52 may be partially condensed on the shell side of the exchanger and the phase separator 30 may be eliminated. Essentially, exchanger 20 and separator 30 may be combined into a single device. Depending upon the elevation relative to the entry point of pass 41, a liquid refrigerant pump may be employed to motivate the liquid phase from separator 30 to the inlet of exchanger 40. Alternatively, cooling means 20 and 120 may be partitioned into several separate exchangers. This may be advisable if more than one cooling utility is available, for instance chilled water.

Primary heat exchanger 40 may be replaced with multiple exchangers. In such an arrangement, the refrigerant stream exiting pass 41 may be distributed accordingly for purposes of condensing both the incoming refrigerant streams. Although the use of brazed aluminum plate fin type exchangers are preferred for service as exchanger 40, it is also possible to employ other exchanger types including plate frame and shell and tube.

Valves 50 and 130 may be comprised of combination of expansion devices. Conventional automatic and thermoacoustic valves may be used. Alternatives include the use of specialized distribution headers of exchanger 40 as well as orifice plates and tubes. Although it is the intent of the invention to eliminate the need for cold end phase separators, it may be necessary to include such vessels. In these arrangements, the streams entering exchanger 40 passes 42 and 44 would be phase separated prior to entry. Designated distribution headers could be included for the segregated liquid and vapor streams.

What is claimed is:

1. A method for providing refrigeration comprising:

(A) condensing a first multicomponent refrigerant to produce a saturated liquid, expanding the saturated liquid first multicomponent refrigerant, and vaporizing the expanded first multicomponent refrigerant by indirect heat exchange with the condensing first multicomponent refrigerant;

(B) condensing a second multicomponent refrigerant by indirect heat exchange with the vaporizing first multicomponent refrigerant, said second multicomponent refrigerant having a dew point which is less than the dew point of said saturated liquid first multicomponent refrigerant, and said second multicomponent refrigerant having bubble point which is greater than the bubble point of said vaporizing first multicomponent refrigerant; and (C) vaporizing the condensed second multicomponent refrigerant by passing heat from a refrigeration load into the condensed second multicomponent refrigerant thereby providing refrigeration to the refrigeration load.

2. The method of claim 1 wherein the second condensing multicomponent refrigerant has a dew point which is less than the bubble point of the first condensing multicomponent refrigerant.

3. The method of claim 1 further comprising superheating the vaporized second multicomponent refrigerant by indirect heat exchange with the condensing second multicomponent refrigerant and with the condensing first multicomponent refrigerant.

4. The method of claim 1 further comprising subcooling the first multicomponent refrigerant prior to expansion.

5. The method of claim 1 wherein the first multicomponent refrigerant comprises at least one fluorocarbon.

6. The method of claim 1 further comprising subcooling the second multicomponent refrigerant prior to providing refrigeration to the refrigeration load.

7. The method of claim 1 wherein the refrigeration load is food freezing.

8. The method of claim 1 wherein the refrigeration is provided to the refrigeration load at a temperature within the range of from −110° F. to −160° F.

9. The method of claim 1 wherein the condensation of the second multicomponent refrigerant occurs at a temperature less than −80° F.

10. The method of claim 1 wherein the second multicomponent refrigerant comprises at least 80 mole percent tetrafluoromethane.

11. The method of claim 1 wherein the second multicomponent refrigerant comprises tetrafluoromethane, fluoroform and argon.

12. The method of claim 1 wherein the second multicomponent refrigerant comprises nitrogen.

* * * * *